United States Patent [19]

Hayama et al.

[11] Patent Number: 4,911,069

[45] Date of Patent: Mar. 27, 1990

[54] ROTARY STENCIL PRINTER HAVING PRINTING DRUM HAVING OUTER PERIPHERAL WALL PORTION SUBSTANTIALLY MADE OF ONLY NET MATERIAL

[75] Inventors: Noboru Hayama; Yoshiharu Ohinata; Kazuo Sakamoto, all of Tokyo, Japan

[73] Assignee: Riso Kagaku Corporation, Japan

[21] Appl. No.: 302,194

[22] Filed: Jan. 27, 1989

[30] Foreign Application Priority Data

Feb. 9, 1988 [JP] Japan ..... 63-28553

[51] Int. Cl.[4] ..... B41L 13/00

[52] U.S. Cl. ..... 101/120; 101/127.1

[58] Field of Search ..... 101/120, 119, 116, 127, 101/128.1, 127.1; 118/406

[56] References Cited

U.S. PATENT DOCUMENTS

| | | | |
|---|---|---|---|
| 2,906,201 | 9/1959 | Blair, Jr. | 101/120 |
| 3,232,224 | 2/1966 | Kramer | 101/128 |

FOREIGN PATENT DOCUMENTS

| | | | |
|---|---|---|---|
| 513447 | 6/1955 | Canada | 101/120 |
| 0055889 | 4/1980 | Japan | 101/120 |
| 0084961 | 7/1981 | Japan | 101/120 |
| 161805 | 1/1958 | Sweden | 101/120 |
| 1350812 | 4/1974 | United Kingdom | 101/120 |

*Primary Examiner*—Eugene H. Eickholt

*Attorney, Agent, or Firm*—Stevens, Davis, Miller & Mosher

[57] ABSTRACT

In a rotary stencil printer having a printing drum supported to be rotatable about a central axis thereof and having a cylindrical outer surface adapted to bear a perforated stencil sheet as attached therearound and formed with openings for supplying ink to an inside surface of the perforated stencil sheet, and a back press roller supported to be rotatable about a central axis thereof extending in parallel with the central axis of the printing drum and having a cylindrical outer surface which defines a nip area with the cylindrical outer surface of the printing drum therebetween for nipping and transferring a printing sheet therethrough. The printing drum has an outer peripheral wall portion substantially made of only a net material constructed by weaving or knitting filaments to provide the cylindrical outer surface thereof formed with the openings, and an internal press roller is provided so as to engage the outer peripheral wall portion at a radially inside surface thereof and to press the outer peripheral wall portion radially outwardly toward the back press roller, thereby locally elastically deforming the net material to traverse a nip area clearance when a printing sheet is supplied in the nip area.

3 Claims, 2 Drawing Sheets

ROTARY STENCIL PRINTER HAVING PRINTING DRUM HAVING OUTER PERIPHERAL WALL PORTION SUBSTANTIALLY MADE OF ONLY NET MATERIAL

BACKGROUND OF THE INVENTION

1. Field of the Invention

The present invention relates to the art of stencil printing, and more particularly, relates to a rotary stencil printer.

2. Description of the Prior Art

As a type of stencil printer there is a rotary stencil printer comprising a printing drum supported to be rotatable about a central axis thereof and having a cylindrical outer surface adapted to bear a perforated stencil sheet as attached therearound and formed with openings for supplying ink therethrough toward an inside surface of said perforated stencil sheet, and a back press roller supported to be rotatable about a central axis thereof extending in parallel with said central axis of said printing drum and having a cylindrical outer surface which defines a nip area with said cylindrical outer surface of said printing drum therebetween for nipping and transferring a printing sheet therethrough, characterized in that said printing drum has an outer peripheral wall portion substantially made of only a net material constructed by weaving or knitting filaments to provide said cylindrical outer surface thereof formed with said openings, and an internal press roller is provided so as to engage said outer peripheral wall portion at a radially inside surface thereof and to press said outer peripheral wall portion radially outwardly toward said back press roller. The printing drum in such a rotary stencil printer is conventionally constructed in such a structure that a metallic cylinder member having a cylindrical wall is formed with a number of openings through the cylindrical wall thereof for transmitting ink therethrough, said cylindrical wall being constructed to be a plate having a thickness enough to maintain the overall strength and rigidity of the printing drum.

In the rotary stencil printer having the printing drum and the back press roller of the above-mentioned structure ink is supplied to the inside space of the printing drum, and then the ink flows through the openings formed in the cylindrical wall of the printing drum to reach the outside thereof and is supplied to the inside surface of the perforated stencil sheet attached around the cylindrical wall of the printing drum in a cylindrical form, and then the ink flows through the perforation formed in the stencil sheet to reachthe outer side thereof.

In the rotary stencil printer having the above-mentioned conventional structure, for the reasons that the printing drum has the structure of a cylindrical body made of a plate material having a certain substantial thickness, that the ratio of the area allowed for the ink transmitting openings to be bored through the cylindrical body is naturally restricted from the view point of maintaining the strength and the rigidity of the printing drum, and that such a conventional printing drum generally bears two or three windings of a net material made by weaving or knitting filaments and wrapped therearound in order to distribute the respective flows of ink supplied through the mutually apart openings uniformly to intermediate portions between each two adjacent openings, an approaching movement of a substantial amount of ink and accordingly a corresponding substantial time therefor are required before the ink supplied to the inside of the printing drum is uniformly supplied to certain required portions of the stencil sheet mounted over the cylindrical outer surface of the printing drum. Therefore, when a new printing is started with a newly perforated stencil sheet being mounted around the printing drum it is unavoidable to carry out the initial trial printing of at least several printing sheets before a normally high qualaity printing is available.

On the other hand, in the rotary printers, not particularly in the rotary stencil printer, if the printing drum and the back press roller are approached to one another so as to close the nip area when no printing sheet is provided in the nip area, the surface of the back press roller will be stained by the ink on the printing drum. Therefore, it is necessary that the pressing together of the printing drum and the back press roller is only allowed when a printing sheet is provided in the nip area. Therefore, the rotary stencil printer generally incorporates a means for detecting the supply of a printing sheet in the nip area, and in response thereto to drive generally the back press roller toward the printing drum. This is because the back press roller is generally constructed to be smaller and to have less weight than the printing drum, and therefore the back press roller is more suited to be driven quickly in response to the supply of a printing sheet.

Further, in addition to the necessity of the reciprocating movement of the back press roller in synchronization with the supply of the printing sheets, particularly in the rotary stencil printer which has the bar extending along a generatrix of the cylindrical outer surface of the printing drum as an indispensable structural member for holding the leading edge of the stencil sheet to be mounted around the printing drum, because said bar has a structure substantially protruding from the cylindrical outer surface of the printing drum, the back press roller must be moved away from the printing drum to avoid the collision with the bar during the rotation of the printing drum for a distance which is substantially larger than a small clearance necessary for avoiding the back press roller being stained with ink by direct contact with the printing drum. Therefore, in the rotary stencil printer the back press roller is designed to have a much smaller diameter than the printing drum so as the reduce the mass thereof, the nevertheless, because the back press roller must be reciprocated for such a relatively large distance at high acceleration in synchronization with the rotation of the printing drum, the construction for supporting and reciprocating the back press roller needs to have a relatively strong and heavy structure, thereby not only increasing the weight and cost of the printing device but also presenting the problem that relatively high noise is caused in the operation of the printer.

SUMMARY OF THE INVENTION

It is the primary object of the present invention to improve the rotary stencil printer so as to reduce the required number of the initial trial printing to almost zero.

Further, it is the secondary object of the present invention to provide, in relation with the above-mentioned primary object, an improved rotary stencil printer in which the reciprocating movement of the back press roller in synchronization with the rotation of the printing drum is no longer required.

According to the present invention, the above-mentioned primary object is accomplished by a rotary stencil printer comprising a printing drum supported to be rotatable about a central axis thereof and having a cylindrical outer surface adapted to bear a perforated stencil sheet as attached therearound and formed with openings for supplying ink therethrough toward an inside surface of said perforated stencil sheet, and a back press roller supported to be rotatable about a central axis thereof extending in parallel with said central axis of said printing drum and having a cylindrical outer surface which defines a nip area with said cylindrical outer surface of said printing drum therebetween for nipping and transferring a printing sheet therethrough, characterized in that said printing drum has an outer peripheral wall portion substantially made of only a net material constructed by weaving or knitting filaments to provide said cylindrical outer surface thereof formed with said openings, and an internal press roller is provided so as to engage said outer peripheral wall portion at a radially inside surface thereof and to press said outer peripheral wall portion radially outwardly toward said back press roller.

Further, according to the present invention, the above-mentioned secondary object is accomplished by a rotary stencil printer of the above-mentioned construction, wherein said back press roller has substantially the same outer diameter as said printing drum, said printing drum having a bar extending along a generatrix of said cylindrical outer surface thereof for mounting a leading edge of said perforated stencil sheet, said back press roller having a groove extending along a generatrix of said cylindrical outer surface thereof and adapted to receive said bar of said printing drum, said central axes of said printing drum and said back press roller being fixedly spaced from one another for a distance which leaves a predetermined clearance between said cylindrical outer surfaces of said printing drum and said back press roller, said printing drum and said back press roller being drivingly connected with one another so as to rotate in synchronization with one another in mutually opposite rotational directions so that said bar is received in said groove when they meet with one another, said outer peripheral wall portion except a part thereof corresponding to said bar of said printing drum being biased to traverse said clearance and approach said cylindrical outer surface of said back press roller by being selectively pressed radially outwardly from the radially inner side thereof by said internal press roller.

When the outer peripheral wall portion of the printing drum formed with the openings for passing ink therethrough is substantially made of only a net material constructed by weaving or knitting filaments, if the mesh of the net material is appropriately small, the ink supplied to the inside of the printing drum can be quickly supplied to the whole area of the inside surface of the stencil sheet mounted around the printing drum in direct contact with such a net structure. Therefore, when a new printing is started with a new stencil sheet being mounted around the printing drum, even the first print, or the second print even when the print figure has a large contrast in the density of spots to be inked, can be a normal print.

The structure of the printing drum that the outer peripheral wall portion formed with openings for passing ink therethrough is substantially made of only the net material and the internal press roller is incorporated in the printing drum to be maneuverable from the outside thereof is accomplished, according to one embodiment of the present invention, by constructing opposite end portions of the printing drum by a pair of annular elements, firmly connecting to these two annular elements by a bar member which, in any event, is indispensable for mounting the leading edge of a stencil sheet, and mounting the net material between the two annular elements as extending therebetween in a cylindrical form.

When a substantial portion of the outer peripheral wall portion of the printing drum formed with the openings for passing ink therethrough is substantially made of only the net material, the net wall portion has a high flexibility and local expandability. Therefore, if a part of the net wall portion of the printing drum confronting the back press roller is pressed from the inside thereof radially outwardly by the internal press roller, said part can easily expand elastically in the radially outward direction. Therefore, by the control of the movement of the internal press roller in the radial direction the controlling of the nip area between the printing drum and the back press roller such as to press together the printing drum and the back press roller only when a printing sheet is supplied in the nip area and to avoide the direct contact between the printing drum and the back press roller when no printing sheet is supplied in the nip area is accomplished by maintaining the distance between the central axes of the printing drum and the back press roller to be constant. Therefore, no reciprocating mechanism for the back press roller is required, and therefore the problem of the operation noise is dissolved.

In order to avoid the direct contact between the printing drum and the back press roller when no printing sheet is supplied in the nip area, the outer peripheral surfaces of the printing drum and the back press roller need only be apart from one another for only a few millimeters. Such a small distance can be easily covered by the elastic deformation of the outer peripheral wall portion of the printing drum substantially made of the net material that will be easily available by pressing the corresponding part of the outer peripheral wall portion by the internal press roller.

It is of course necessary to avoide the collision between the bar provided along a generatrix of the cylindrical outer surface of the printing drum and the back press roller when the bar passes through the nip area where the cylindrical outer surfaces of the printing drum and the back press roller are positioned in close proximity. This is accomplished by constructing the back press roller to have the same outer diameter as the printing drum, driving the printing drum and the back press roller in synchronization at the same rotational speed but in mutually opposite rotational directions, and forming a groove in the back press roller along a generatrix of the cylindrical outer surface thereof so as to receive the bar of the printing drum when they meet with one another. Since the back press roller is no longer to be reciprocated like the conventional back press roller in synchronization with the rotation of the printing drum, the amount of mass of the back press roller is no longer an important matter, and therefore there will be no problem in constructing the back press roller to have the same outer diameter as the printing drum.

BRIEF DESCRIPTION OF THE DRAWINGS

In the accompanying drawings.

DESCRIPTION OF THE PREFERRED EMBODIMENT

In the following the present invention will be described in detail with respect to a preferred embodiment thereof with reference to the accompanying drawing.

Figure 1:
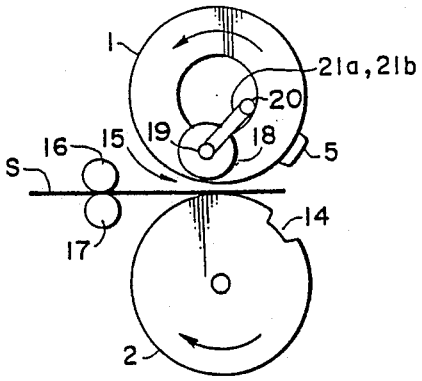
FIG. 1 is a side view showing schematically essential portions of the construction of the rotary stencil printer according to the present invention.
Figure 2:
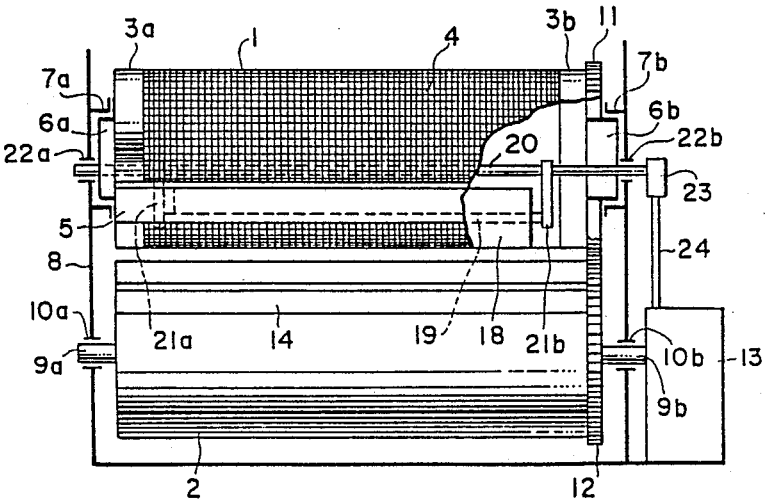
FIG. 2 shows a view of the printing device including the construction shown in FIG. 1 as viewed from the right side of the printer in FIG. 1.

FIG. 1 is a side view showing schematically the structure of the essential portions of the rotary printing device according to the present invention, and FIG. 2 shows a view of a rotary printer including the construction shown in FIG. 1 as viewed from the right side thereof in FIG. 1.

In these figures, 1 is a printing drum, and 2 is a back press roller. The printing drum 1 has opposite end portions constructed by rigid annular members 3*a* and 3*b*, and an outer peripheral wall portion substantially made of only a net material 4 constructed by weaving or knitting filaments, the net material being extended in a cylindrical form between the annular members 3*a* and 3*b*. A bar 5 for holding a leading edge of a stencil sheet mounted around the printing drum is provided to extend along a generatrix of the printing drum, said bar also serving as a member for firmly connecting the annular members 3*a* and 3*b* with one another. Although not shown in detail in these figures, the bar 5 is provided with some metal fittings and others which are well known in the art in various kinds for fastening the leading edge of a stencil sheet to the bar. The printing drum 1 is supported from a casing 8 to be rotatable about a central axis thereof at the opposite annular members 3*a* and 3*b* by annular bearing projections 6*a* and 6*b* extending sidewardly from the annular members 3*a* and 3*b* being rotatably received in corresponding bearing members 7*a* and 7*b* mounted to the casing.

The back press roller 2 is also supported from the casing 8 to be rotatable about a central axis thereof by shaft members 9*a* and 9*b* extending from the opposite ends thereof being rotatably received in corresponding bearing members 10*a* and 10*b*.

The printing drum 1 and the back press roller 2 are drivingly connected by mutually meshing annular gear wheels 11 and 12 of a same diameter and respectively mounted at one end of the printing drum and the back press roller so that they are rotated in synchronization at a same rotational speed in mutually opposite rotational directions, as shown by arrows in FIG. 1. This rotational driving is powered by a driving device 13 which includes an electric motor therein and drives the shaft member 9*b* of the back press roller. The back press roller 2 is formed with a groove 14 to receive the bar 5 of the printing drum 1 when they meet with one another.

In FIGS. 1 and 2 the clearance between the cylindrical outer surfaces of the printing drum 1 and the back press roller 2 is shown as exaggerated to be much larger as compared with the diameters of the printing drum and the back press roller. This clearance may actually be a very small amount such as 2–5 mm when the diameter of the printing drum is 10 inches or more. The clearance provides a nip area 15 for nipping a sheet S to be applied with a printing image in the printing process. Rollers 16 and 17 are feed rollers for feeding the sheet S toward the nip area 15.

Figure 3:
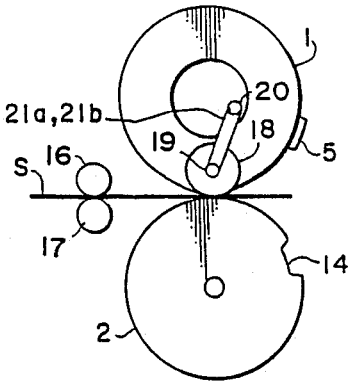
FIG. 3 is a view similar to FIG. 1 showing another operational condition of the construction shown in FIG. 1.

An internal press roller 18 is provided at the inside of the printing drum 1 so as selectively to press such a part of the outer peripheral wall portion substantially made of only the net material 4 that extends along a generatrix of the cylindrical outer surface of the printing drum and confronts the back press roller 2 radially outwardly toward the back press roller. The internal press roller 18 is rotatably supported by a shaft 19 extending along a central axis thereof. The shaft 19 is supported at opposite ends thereof by a pair of arms 21*a* and 21*b* which are in turn supported by a shaft 20. The shaft 20 extends through the annular bearing projections 6*a* and 6*b* at the opposite ends of the printing drum 1 and is rotatably supported from the casing 8 by bearing members 22*a* and 22*b*. One end of the shaft 20 is connected with the driving means 13 by a lever 23 and a link 24 so as to be driven by the driving device 13 in synchronization with the rotations of the printing drum 1 and the back press roller 2 when and only when a printing sheet is applied to the nip area 15. In other words, when the sheet S is supplied to the nip area 15 and the printing is to be carried out, the internal press roller 18 is moved to the position shown in FIG. 3 so as elastically to push the outer peripheral wall portion of the printing drum substantially made of only the net material, except a part thereof which extends along the bar 5, radially outwardly toward the back press roller.

The printing ink is supplied to the inside of the printing drum 1 by an ink supply device not shown in the figure, and transferred toward the nip area 15 in the same manner as in the conventional rotary stencil printer so as to be supplied to the inside surface of the outer peripheral wall portion thereof. In the conventional rotary stencil printer an ink supply roller which looks just like the internal press roller 18 as viewed in the figure is provided to paint the ink supplied to the inside of the printing drum on the inside surface of the outer peripheral wall portion of the printing drum at the position corresponding to the nip area 15. In the rotary stencil printer according to the present invention such an ink supply roller may be served by the internal press roller 18. Therefore, in the embodiment shown in the figure the internal press roller 18 operates as a means to press the outer peripheral wall portion substantially made of only the net material selectively radially outwardly toward the back press roller 2 and also operates as the ink supply roller for supplying ink to the outer peripheral wall portion of the printing drum from the inside thereof. It will be appreciatd that this internal press roller operates just in same manner as the manual press roller which is used with the primitive manual stencil printer having a rectangular frame work supporting a net material, as a means for pressing the stencil sheet to the printing surface and also as the means for supplying ink to the stencil sheet.

According to the above construction the outer peripheral wall portion substantially made of only the net material in the printing drum can supply the ink introduced into the inside thereof directly to the whole area of the stencil sheet mounted therearound through the thin porous net layer, and therefore, when a new printing is started with a new stencil sheet being mounted around the printing drum, a sufficient supply of ink is available even for the first printing sheet, whereby the conventional useless repetitions of the trial printing can be avoided.

Further, no device for changing the inter axial distance between the printing drum 1 and the back press roller 2 in synchronization with the rotation of the printing drum is required, while the movement of the internal roller 18 between the positions shown in FIG. 1 and in FIG. 2 is accomplished by a slight turning of the shaft 20 in the shown embodiment, requiring a very simple driving construction. Since the internal press roller 18 may be of a light construction and the distance of movement is very small, such an operation of the internal press roller will generate no substantial noise.

Figure 4:
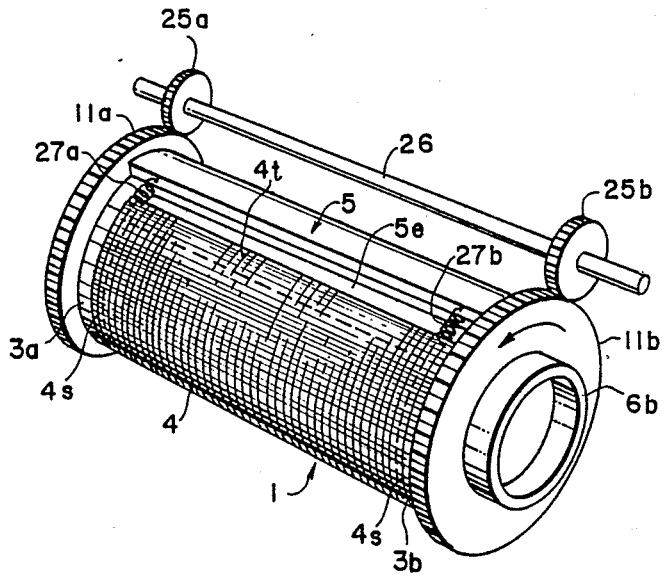
FIG. 4 is a perspective view showing a more detailed construction of the printing drum.

FIG. 4 shows the construction of the printing drum in more detail with some modification to the construction shown in FIG. 2. First, in the construction shown in FIG. 4 a pair of gear wheels 11*a* and 11*b* are provided at opposite ends of the printing drum 1, instead of the gear wheel 11 provided only at one end of the printing drum. In accordance with this a pair of pinions 25*a* and 25*b* mutually connected by a shaft 26 to transmit torque therebetween are provided so as to mesh with the gear wheels 11a and 11b, respectively. The shaft 26 is adapted to be mounted at opposite end portions thereof to the casing 8 via a pair of bearing members not shown to be rotatable about a central axis thereof. It will be noted that by the provision of the pinions 25*a* and 25*b* connected by the shaft 26 and the pair of gear wheel 11*a* and 11*b* the pair of annular members 3a and 3b connected by the bar 5 will rotate in better unity than in the construction shown in FIG. 2 where the transmission of the driving torque from the annular member 3*b* to the annular member 3*a* depends only upon the bar 5.

Further, in the printing drum shown in FIG. 4, the net material 4 of a rectangular plan shape is firmly mounted to the bar 5 only at a leading edge thereof located at a forward end as viewed in the moving direction thereof with the cylindrical outer surface of the printing drum in the rotation thereof. In other words, assuming that the printing drum rotates in the direction shown by an arrow in FIG. 4, the leading edge of the net material is located behind the bar 5 therealong and not seen in FIG. 4. Starting from this leading edge the net material 4 is freely wound around the pair of annular members 3*a* and 3*b* with opposite side edge strip portions 4s thereof being merely laid on axially inside rim portions of the annular members 3*a* and 3*b*, and a trailing edge indicated by 4*t* of the net material opposite to said leading edge is laid on a side extension 5*e* of the bar 5 prepared to provide a strip surface corresponding to generatrices of the cylindrical outer surface of the printing drum in this region. Then the trailing edge 4*t* of the net material 4 is elastically pulled toward the bar 4 by a pair of expansion springs 27*a* and 27*b* connected thereto near opposite side edge portions thereof, so that the net material is as a whole neatly fitted around the pair of annular members 3*a* and 3*b* in a cylindrical form under a light elastic tension, with the opposite side edge strip portions 4*s* of the net material being slidable relative to the cylindrical outer peripheral surfaces of the annular members 3*a* and 3*b* in the circumferential directions thereof if any distortional relative rotaion between the pair of annular members 3*a* and 3*b* occurs.

It was confirmed that when the net material 4 is mounted in the flexible construction as described above, any wrinkling of the stencil sheet attached on the cylindrical net material due to distortion of the net material is effectively avoided, and very high quality of the stencil printing is ensured even at very high speed printing. Further, it will be noted that this flexible mounting of the net material is very advantageous from the view point of the convenience of manufacture and maintenance of the printing drum.

Although the present invention has been described in detail with respect to some preferred embodiments thereof, it will be apparent for those skilled in the art that various other embodiments are possible within the scope of the present invention.

We claim:

1. A rotary stencil printer comprising a printing drum supported to be rotatable about a central axis thereof and having a cylindrical outer surface adapted to bear a perforated stencil sheet as attached therearound and formed with openings for supplying ink to an inside surface of said perforated stencil sheet, and a back press roller supported to be rotatable about a central axis thereof extending in parallel with said central axis of said printing drum and having a cylindrical outer surface which defines a nip area with said cylindrical outer surface of said printing drum therebetween for nipping and transferring a printing sheet therethrough, said printing drum having a frame assembled of a pair of annular members forming opposite end portions thereof and a bar connecting said pair of annular members, and an outer peripheral wall portion substantially made of only a net material constructed by weaving or knitting filaments to provide said cylindrical outer surface thereof formed with said openings, said net material having a rectangular plan shape and being fastened at a leading edge thereof as viewed in a direction of movement thereof according to the rotation of said printing drum while opposite side edge strip portion are freely laid on said annular members and a trailing edge thereof opposite to said leading edge is elastically pulled toward said bar, and an internal press roller positioned so as to engage said outer peripheral wall portions at a radially inside surface thereof and to press said outer peripheral wall portion radially outwardly toward said back press roller.

2. A rotary stencil printer according to claim 1, wherein, said back press roller has substantially the same outer diameter as said printing drum, said printing drum having a bar extending along a generatrix of said cylindrical outer surface thereof for mounting a leading edge of said perforated stencil sheet, said back press roller having a groove extending along a generatrix of said cylindrical outer surface thereof and adapted to receive said bar of said printing drum, said central axes of said printing drum and said back press roller being fixedly spaced from one another for a distance which leaves a predetermined clearance between said cylindrical outer surfaces of said printing drum and said back press roller, said printing drum and said back press roller being drivingly connected with one another so as to rotate in synchronization with one another in mutually opposite rotational directions so that said bar is received in said groove when they meet with one another, said outer peripheral wall portion except a part thereof corresponding to said bar of said printing drum being biased to traverse said clearance and approach said cylindrical outer surface of said back press roller by being selectively pressed radially outwardly from the radially inner side thereof by said internal press roller.

3. A rotary stencil printer according to claim 1, further comprising a pair of gear wheels mounted to said pair of annular members, respectively, a pair of pinions meshing with said pair of gear wheels, respectively, and a shaft connecting said pair of pinions so as to synchronize rotations of said pairs of pinions, gear wheels and annular members.

* * * * *